US006386826B1

(12) United States Patent
Jacob

(10) Patent No.: US 6,386,826 B1
(45) Date of Patent: May 14, 2002

(54) FAN WITH SELF CLOSING BLADES

(75) Inventor: Francois Jacob, Vence (FR)

(73) Assignee: International Business Machines Corporation, Armonk, NY (US)

( * ) Notice: Subject to any disclaimer, the term of this patent is extended or adjusted under 35 U.S.C. 154(b) by 14 days.

(21) Appl. No.: 09/668,259

(22) Filed: Sep. 22, 2000

(30) Foreign Application Priority Data

Sep. 23, 1999 (EP) ..... 99480090

(51) Int. Cl.[7] ..... F04D 29/36
(52) U.S. Cl. ..... 415/125; 415/141
(58) Field of Search ..... 415/60, 61, 33, 415/35, 42, 125, 141, 146, 147

(56) References Cited

U.S. PATENT DOCUMENTS 3,932,054 A * 1/1976 McKelvey ..... 415/130
3,984,194 A * 10/1976 Fermer et al. ..... 416/135
4,590,889 A * 5/1986 Hiereth ..... 123/41.05
6,253,716 B1 * 7/2001 Palmer et al. ..... 123/41.12
6,276,895 B1 * 8/2001 Milana ..... 415/25

FOREIGN PATENT DOCUMENTS

GB 2081878 A * 2/1982 ..... 454/234

* cited by examiner

*Primary Examiner*—F. Daniel Lopez
*Assistant Examiner*—Richard Edgar
(74) *Attorney, Agent, or Firm*—Ira D. Blecker

(57) ABSTRACT

A fan system to be mounted over an opening including a plurality of pivoting blades fixed on a free wheeling element and a motor driven element wherein, in operation, when the fan is operating the motor driven element pivots the blades to a blowing position allowing air flow through the opening, and when the fan is not operating a resilient member pivots the blades to a closed position preventing air flow through the opening.

14 Claims, 10 Drawing Sheets

Blade in Open Position

Blade in Closed Position

FAN WITH SELF CLOSING BLADES

TECHNICAL FIELD OF THE INVENTION

The present invention relates to a system for cooling a box comprising electronic devices and more particularly to a fan with self closing blades for, in case of failure, preventing air leakage in a box comprising a plurality of fans.

BACKGROUND ART

In many electronic systems, the electronic cards are cooled by air. An air flow goes through the electronic cards, and thus cools down the electronic components situated on the cards. This allows power dissipation in such components and maintains the silicon temperature of such electronic components (in particular semiconductor chips) to a value compatible with specifications.

The common implementation of a cooling system in a large computer or telecommunication system comprising a plurality of electronic devices is to arrange an array of fans (blowers, ventilators) controlled by a servo mechanism capable of detecting over temperature conditions, lack of fresh air, air renewal deficiency, defective air circulation, fan failures or malfunctions, and capable of adjusting the speed of these fans to actual conditions. Generally, an additional blowing capacity in large electronic systems is required for, in case of fan failure, replacing the air flow that was previously generated by the failing fan, and providing an additional air flow to compensate for the air leakage through the failing fan.

This implies complex sensors, powerful amplification for fan servo control, and backup fans for replacing the failing fan. A solution for reducing the air leakage through the failing fan and to limit the additional blowing capacity required is to add a mechanism on top of each fan to close the fan opening in case of failure.

UK Patent Application 2 081 878 A and U.S. Pat. No. 4,590,889, the disclosures of which are incorporated by reference herein, disclose ventilation arrangements with pivotable blades for closing the opening of a ventilation duct.

More particularly, UK Patent Application 2 081 878 A entitled "Ventilators" (Bardsley) discloses a ventilation apparatus adapted to combine the operating features of an air extract system and a recirculation system comprising a number of pivoted blades or shutters mounted over openings in the sides of a vertical exhaust duct. Below the opening is mounted a reversible air flow fan. When the fan is blowing air up, the blades are blown open, to allow air to pass up the duct, at the same time the blades also close the openings in the sides of the duct. When the fan is off, the blades, due to their slight imbalance fall down onto a stop within the duct to hold the blades in a horizontal position forming a "back-draught" shutter. When the fan is reversed and blowing down, the blades remain in their horizontal position and air is drawn through the openings in the duct and discharged down by the fan.

U.S. Pat. No. 4,590,889 entitled "Arrangement for Influencing a Cooling Air Flow" (Hiereth) discloses an arrangement for influencing a cooling air flow passing through a cooling air system of an internal-combustion engine of a vehicle including a heat exchanger and a blower arranged in an air guiding housing, a cooling air outlet opening being arranged in the air guiding housing between the blower and a wall of an internal-combustion engine capsule in the area of the bottom side of the vehicle. In order to achieve a better efficiency of the blower and in order to prevent the emission of sounds from the ventilated capsule, pivotable guide blades are arranged in flow direction in front of and/or behind the running blades of the blower which, as a function of the position, closes the cooling air inlet opening to the capsule and opens the cooling air outlet opening arranged in the air guiding space between the heat exchanger and the blower.

None of these documents approaches the problem of closing the a opening of a failing fan for reducing air leakage in a box or enclosure comprising a plurality of fans.

OBJECTS OF THE INVENTION

It is an object of the present invention to limit the additional blowing capacity required to cool a box comprising electronic devices in case of fan failure.

It is a further object of the present invention to limit the air leakage generated by a failing fan.

It is a further object of the present invention to close the opening of a failing fan whatever the position, horizontal or vertical, of the box.

It is a further object of the present invention to simplify the air cooling in a box comprising a plurality of fans.

BRIEF SUMMARY OF THE INVENTION

The present invention relates to a system for cooling a box comprising electronic devices and more particularly to a fan with self closing blades for, in case of failure, preventing air leakage in a box comprising a plurality of fans.

The present invention is directed to a fan system to be mounted over an opening and comprising a plurality of pivoting blades fixed on a central rotating element. The fan system comprises:

a central rotating element and means for automatically closing the opening with the surface of the blades when the fan is stopped, comprising means for pivoting each blade around an axis fixed on the central rotating element from an open to a closed position; means for automatically placing blades in a blowing position when the fan is running, comprising means for pivoting each blade around an axis fixed on the central rotating element from a closed position to a blowing position.

The fan system further comprises at least one fan to be mounted over an opening comprising:

a motor driven element having first stops;

a free wheeling element;

a plurality of pivoting blades fixed on the free wheeling element; and resilient members fixed on the free wheeling element wherein, in operation, when the fan is operating and the motor driven element is engaged, the first stops push the pivoting blades to a first, blowing position, and when the fan is not operating, the resilient members push the pivoting blades to a second , closed position.

The fan system further comprises:

a motor driven element comprising means for rotating the blades and for pivoting the blades from the closed to the blowing position.

The central rotating element is a free wheeling element comprising for each blade:

means for positioning each blade in the closed position;

means for positioning each blade in the open position; and means for pivoting each blade from the blowing to the closed position.

BRIEF DESCRIPTION OF THE DRAWINGS

The novel and inventive features believed characteristic of the invention are set forth in the appended claims. The invention itself, however, as well as a preferred mode of use, further objects and advantages thereof, will best be understood by reference to the following detailed description of an illustrative detailed embodiment when read in conjunction with the accompanying drawings, wherein:

PREFERRED EMBODIMENT OF THE INVENTION

An object of the invention is to avoid the problem of air leakage generated by a failing or malfunctioning fan. When a fan fails, it not only stops producing an air flow, but it also generates an air leakage to the box. Consequently, additional blowing capacity is required from the fan system to compensate for this air leakage and to correctly cool electronic devices arranged within the box. This problem is illustrated in FIGS. 1 and 2.

Figure 1:
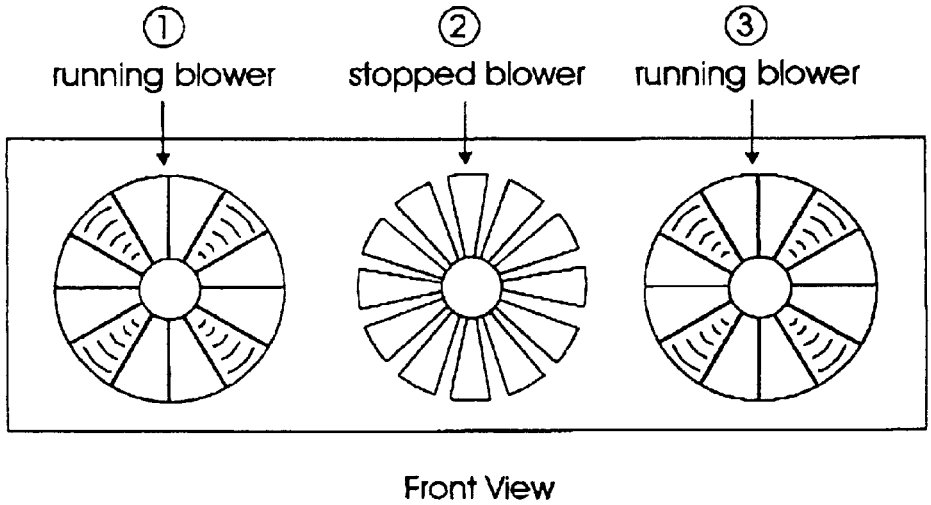
FIG. 1 (Prior Art)
FIG. 1 is a front view of a fan system for cooling a box comprising a plurality of electronic devices according to prior art.
Figure 2:
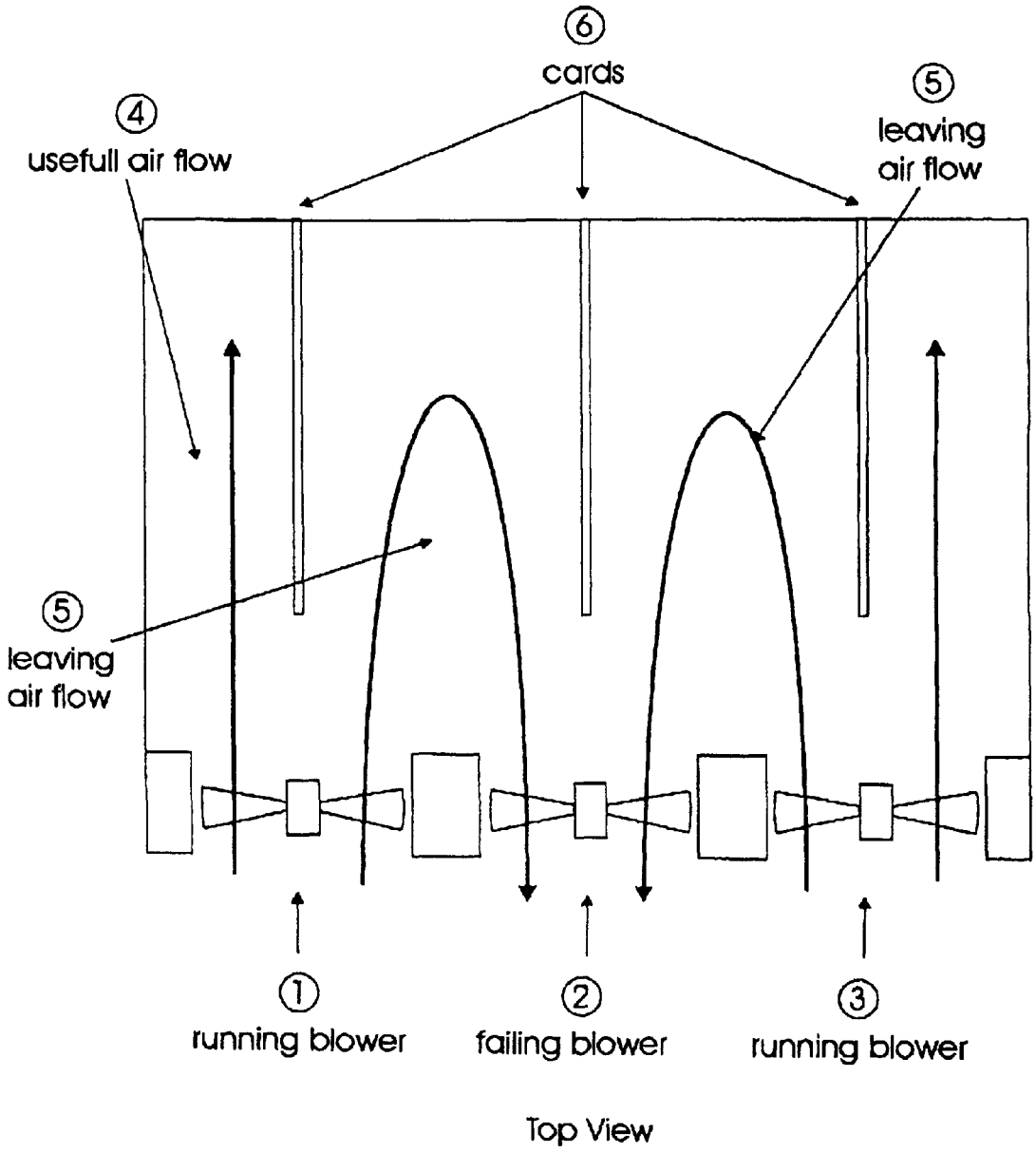
FIG. 2 (Prior Art)
FIG. 2 is a top view of a box comprising a plurality of electronic cards and a plurality of fans for cooling said electronic cards according to prior art.

FIG. 1 is a front view of a fan system according to the prior art for cooling a box or an enclosure comprising a plurality of electronic devices. FIG. 2 is a top view of a box or an enclosure comprising a plurality of electronic cards (6) and a plurality of fans (1,2,3) for cooling the electronic components mounted on said cards (6) according to prior art. The fan (2) in the middle of the cooling system is stopped. The two other fans on the left (1) and on the right (3) are operating (blowing).

One part of the remaining air flow (4) is oriented towards the cards (6) and can usefully cool the electronic components mounted on said cards (6). Another part (5) of the remaining air flow goes through the stopped fan and is lost.

The problem to solve is to prevent the air leakage that occurs in case of fan failure or malfunction in view of reducing the backup blowing capacity, and thus simplifying air cooling systems. This can be achieved with a special fan system where in a closed position the fan opening is obstructed by the surface of the blades. In this fan system, blades are in a closed position when the fan is stopped, and in an open (blowing) position when the fan is running (blowing). With the rotation of the fan, the blades are mechanically set to the open position.

The present invention relates to a fan system comprising:

- a free wheeling part comprising means for positioning blades;
- a motor driven part comprising stops for driving blades;
- a plurality of blades arranged on the free wheeling part, each blade comprising means for pivoting from an open to a closed position around an axis fixed on the free wheeling part.

Figure 5:
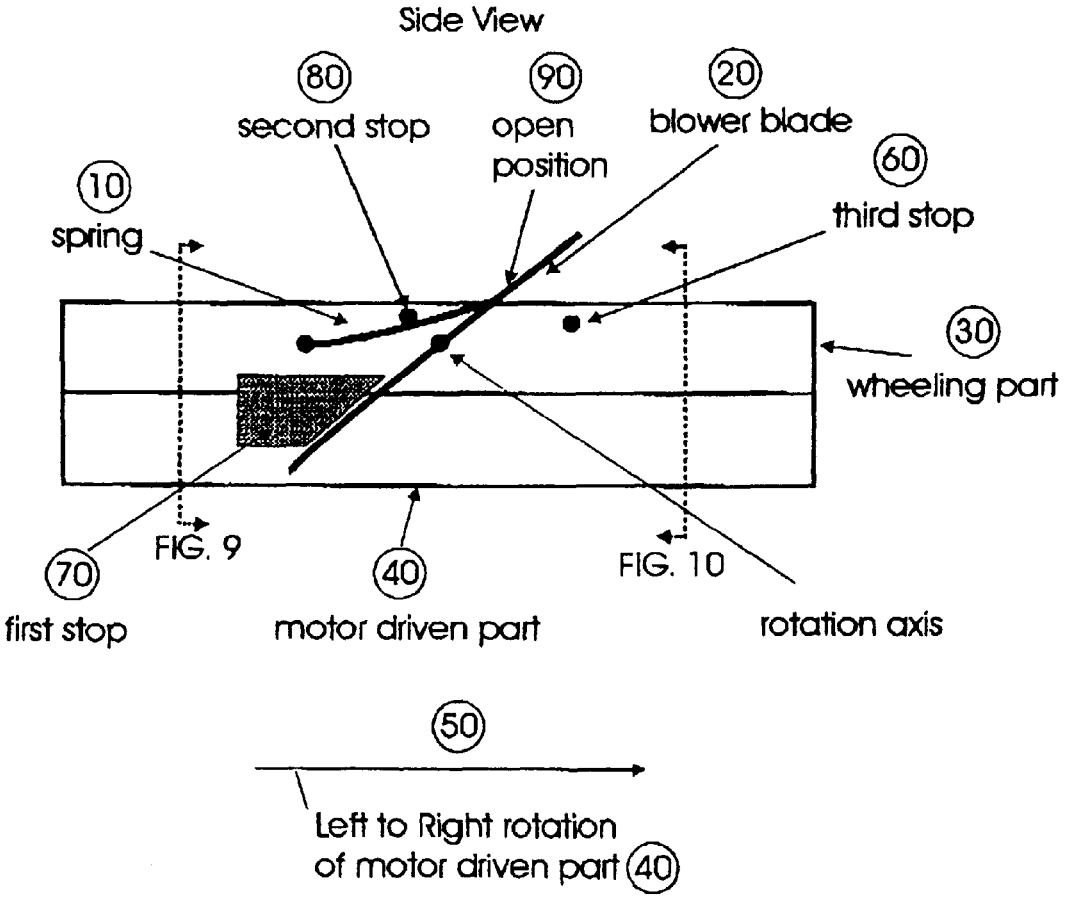
FIG. 5 is a side view of a blade in an open position according to the present invention
Figure 6:
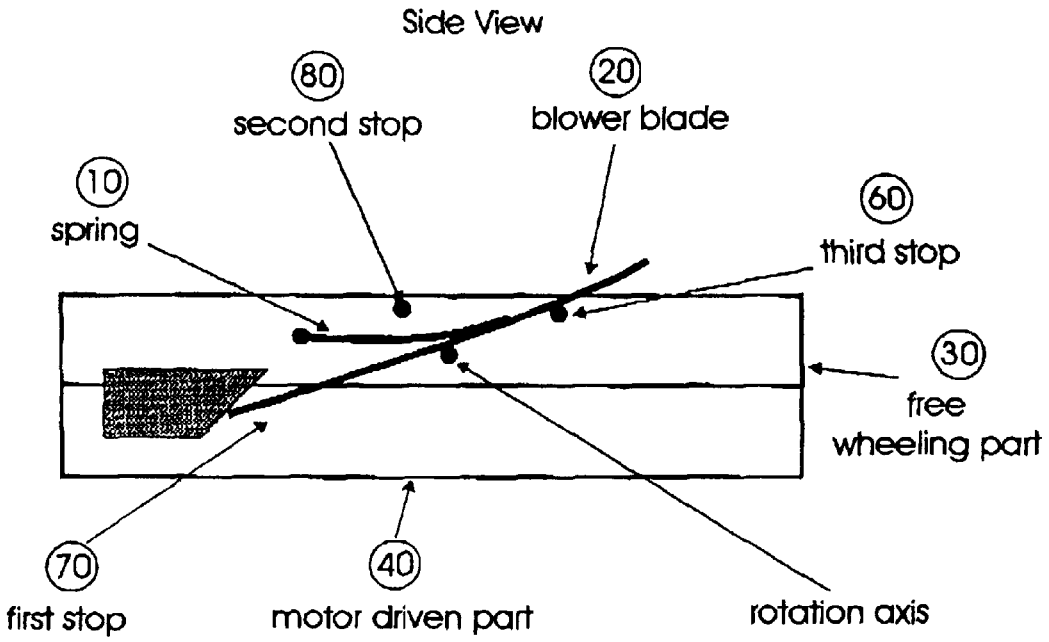
FIG. 6 is a side view of a blade in a closed position according to the present invention.

FIGS. 5 and 6 are side views of the fan system according to the present invention. For the clarity of description, only one blade is represented. FIG. 5 shows a blade in an open position when the fan is running (blowing), while FIG. 6. shows a blade in a closed position when the fan is stopped.

Open Position

Figure 7:
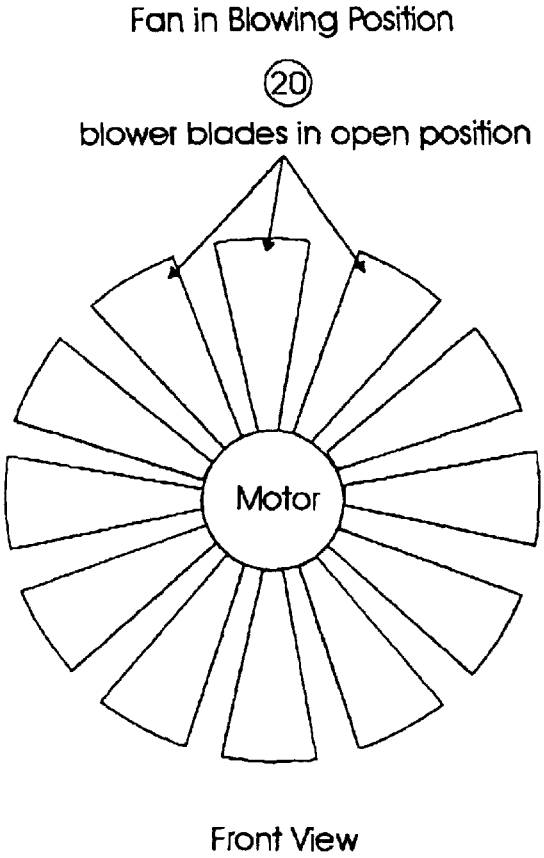
FIG. 7 is a front view of a fan in a blowing position according to the present invention.
Figure 9:
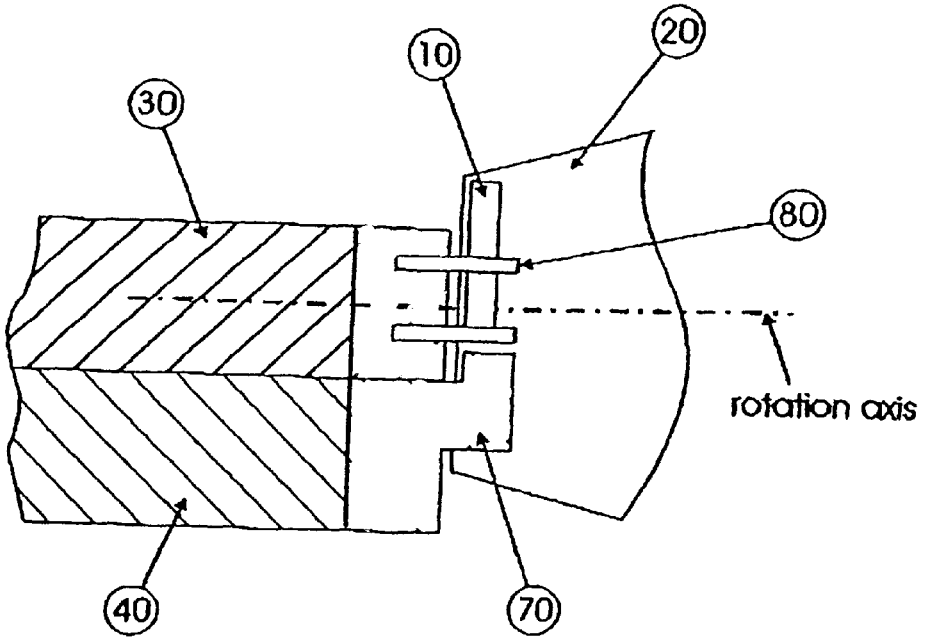
FIG. 9 is a cross section view of the fan system shown in FIG. 5 in the direction of the arrows indicated.

As illustrated in FIG. 5, when the fan blows, each blade (20) is pushed to an open position by the action of the motor driven part (40) on the blades (20) fixed on the free wheeling part (30). Motor driven part (40) and free wheeling part (30) are hubs mounted on the same shaft (not shown) of the fan. Rotation of the shaft drives motor driven part (40) only. The motor driven part (40) rotates in the left to right direction given by the arrow (50). This motor driven part (40) drives the free wheeling part by the action of a first set of stops (70) fixed to motor driven part (40). Each blade is pushed by the first stops (70) fixed on the motor driven part (40) and encounters a spring (10) fixed to free wheeling part (30). Thus each blade pivots to an open position (90), until jammed by a second stop (80) fixed to free wheeling part (30). In this open position, the fan generates an air flow, and behaves as a normal fan. FIG. 9 is a cross section view of the fan system according to the present invention shown in FIG. 5. For clarity of description, only one blade is represented. FIG. 9 shows in particular the blade (20) engaged and pushed by said first stops (70) fixed on the motor driven part (40) of the fan system. FIG. 9 also shows blade (20) engaged by a spring (10) fixed on the free wheeling part (30), the spring (10) jammed by a second stop (80) fixed on the free wheeling part (30) of the fan system. FIG. 7 is a front view of a fan in an open position according to the present invention. FIG. 7 shows in particular, the position of blades (20) (for example 12 blades shown in FIG. 7) oriented for blowing air. The position of blades (determined by the position of the second stops (80)) is optimized for a maximum efficiency.

Closed Position

Figure 8:
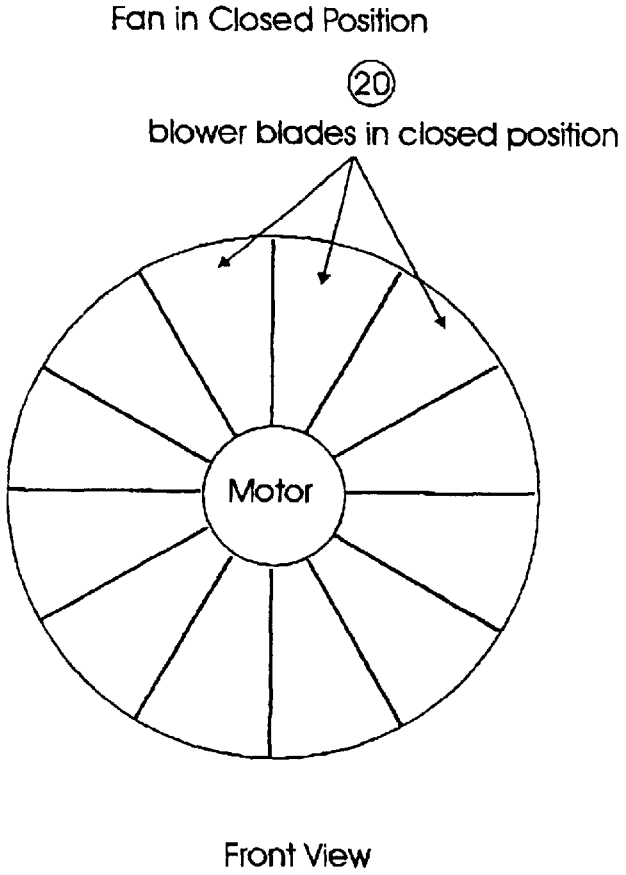
FIG. 8 is a front view of a fan in a closed position according to the present invention.
Figure 10:
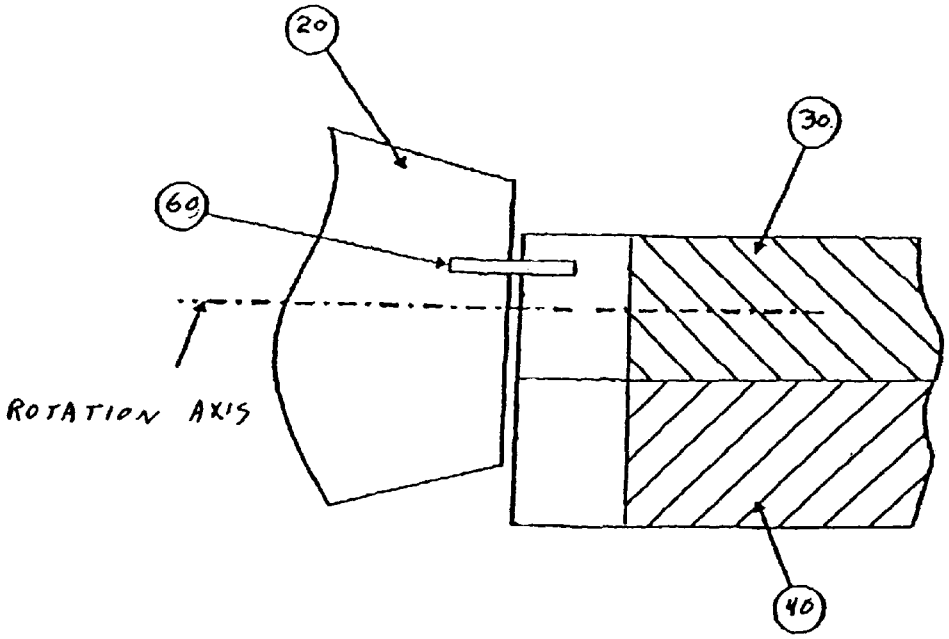
FIG. 10 is a cross section view of the fan system shown in FIG. 5 in the direction of the arrows indicated.

As illustrated in FIG. 6, when the fan stops (i.e., motor driven part (40) is no longer engaged) and blade (20) is no longer pushed to an open position by first stop (70), each blade (20) is then pushed to a closed position by means of spring (10) until jammed by a third stop (60). Blade (20), spring (10) and third stop (60) are located on the free wheeling part (30) of the fan. This assembly (10, 20, 30, 60) is free to rotate independently of the motor driven part (40). FIG. 10 is a cross section view of the fan system according to the present invention shown in FIG. 6. For clarity of description, only one blade is represented. FIG. 10 shows in particular the blade (20) jammed by third stop (60) fixed on the free wheeling part (30) of the fan system. FIG. 8 is a front view of a fan in a closed position according to the present invention. FIG. 8 shows, in particular, the fan opening obstructed by the blades (for example, 12 blades shown in FIG. 8), the blades being oriented in the plane of the fan opening, perpendicularly to the rotation axis of the motor driven part (40). The design of blades is optimized for a maximum efficiency in the open position and a maximum air tightness in the closed position.

Figure 3:
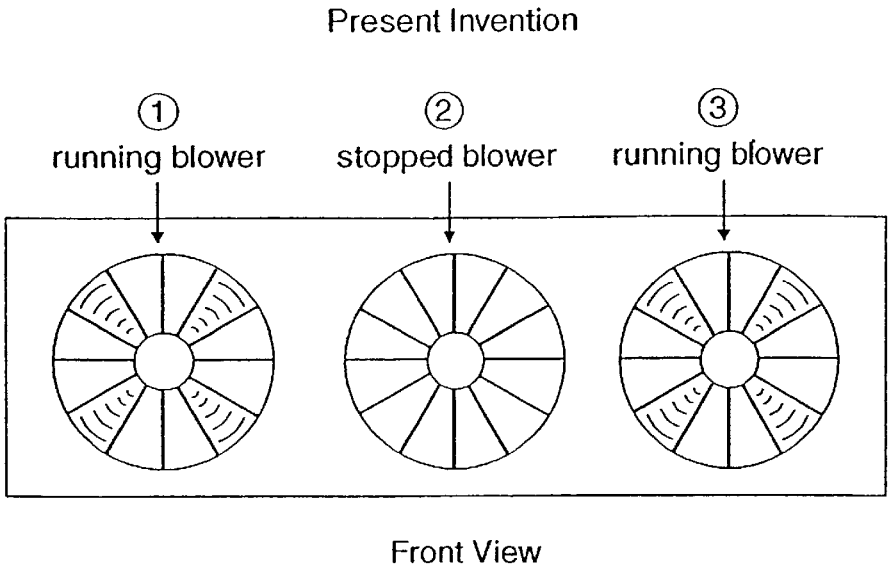
FIG. 3 is a front view of a fan system for cooling a box comprising a plurality of electronic devices according to the present invention.
Figure 4:
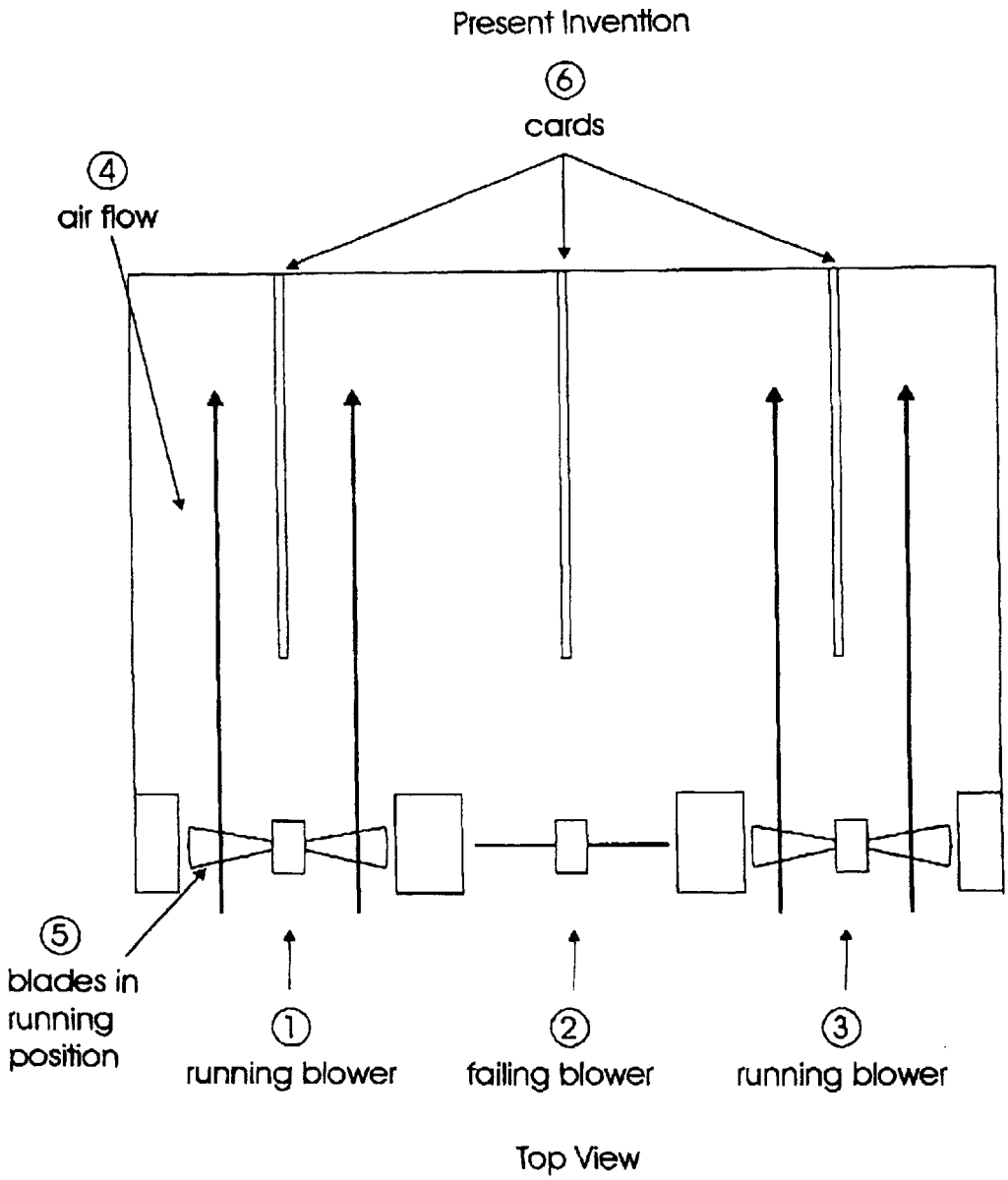
FIG. 4 is a top view of a box comprising a plurality of electronic cards and a plurality of fans for cooling said electronic cards according to the present invention.

FIGS. 3 and 4 show the advantages of the present fan system. FIG. 3 is a front view of the fan system according to the present invention for cooling a box or an enclosure comprising a plurality of electronic devices . FIG. 4 is a top view of a box or an enclosure comprising a plurality of electronic cards and a plurality of fans for cooling the electronic components mounted on said cards (6) according to the present invention. The fan (2) in the middle of the cooling system is off and its blades are in a closed position obstructing the fan opening. The two other fans on the left (1) and on the right (3) are operating and their blades are in an open position.

All the air flow (4) generated by fans (1, 3) is oriented towards the cards (6) and can usefully and efficiently cool the electronic components mounted on said cards (6).

The opening of the stopped fan (2) is closed. No air flow is lost.

While the invention has been particularly shown and described with reference to a preferred embodiment, it will be understood that various changes in form and detail may be made therein without departing from the spirit, and scope of the invention.

I claim:

1. A fan system comprising at least one fan to be mounted over an opening comprising:

a central rotating element (30);

a plurality of pivoting blades (20) fixed on the central rotating element (30);

means for automatically closing the opening with the surface of the blades when the fan is stopped comprising means for pivoting each blade (20) around an axis fixed on said central rotating element (30) from an open to a closed position; and means for automatically placing blades in a blowing position when the fan is running comprising means for pivoting each blade (20) around an axis fixed on said central rotating element (30) from a closed position to a blowing position.

2. The fan system according to claim 1 further comprising:

a motor driven element (40) comprising means for rotating said blades and for pivoting said blades from the closed to the blowing position.

3. The fan system according to claim 2, wherein said means for rotating said blades are first stops fixed on said motor driven element (40).

4. The fan system according to claim 1 wherein said central rotating element (30) is a free wheeling element and wherein said means for pivoting each blade (20) around an axis comprises:

means for positioning each blade in the closed position; means for positioning each blade in the open position; means for pivoting each blade from the blowing to the closed position.

5. The fan system according to claim 4, wherein said means for positioning each blade in the open position is a second stop.

6. The fan system according to claim 4, wherein said means for positioning each blade in the closed position is a third stop.

7. The fan system according to claim 4, wherein said means for pivoting each blade from the blowing to the close position is a spring.

8. The fan system of claim 1, wherein there are a plurality of fans.

9. A fan system comprising at least one fan to be mounted over an opening comprising:

a motor driven element (40) having first stops (70);

a free wheeling element (30);

a plurality of pivoting blades (20) fixed on the free wheeling element (30); and resilient members (10) fixed on the free wheeling element (30);

wherein, in operation, when the fan is operating and motor driven element (40) is engaged, first stops (70) push said pivoting blades to a first, blowing position and when the fan is not operating, said resilient members (10) push said pivoting blades (20) to a second, closed position.

10. The fan system of claim 9 further comprising second stops (80) fixed on the free wheeling element (30) which limit the pivoting movement of each pivotable blade (20) in the first, blowing position.

11. The fan system of claim 10 further comprising third stops (60) fixed on the free wheeling element (30) which limit the pivoting movement of each pivotable blade (20) in the second, closed position.

12. The fan system of claim 9 wherein the resilient members (10) are springs.

13. The fan system of claim 9 wherein there are a plurality of fans.

14. The fan system of claim 9 wherein motor driven element (40) and free wheeling element (30) are rotatable about the same axis of rotation.

* * * * *